United States Patent [19]

Furuta et al.

[11] Patent Number: 4,899,846

[45] Date of Patent: Feb. 13, 1990

[54] SOUND ABSORBING PIPE

[75] Inventors: Naoyuki Furuta, Tokyo; Shinta Yamamura, Kanagawa, both of Japan

[73] Assignee: Nitto Boseki Co., Ltd., Fukushima, Japan

[21] Appl. No.: 46,687

[22] Filed: May 7, 1987

[30] Foreign Application Priority Data

May 19, 1986 [JP] Japan ..... 61-75054[U]

[51] Int. Cl.[4] ..... G10K 11/00

[52] U.S. Cl. ..... 181/210; 181/205; 181/284; 181/290; 181/293

[58] Field of Search ..... 181/30, 210, 295, 252, 181/233, 259, 267, 258, 200, 224, 205, 284, 293

[56] References Cited

U.S. PATENT DOCUMENTS

| | | | |
|---|---|---|---|
| 1,916,908 | 7/1933 | Stacey, Jr. et al. | 181/224 |
| 3,031,824 | 5/1962 | Court | 181/259 X |
| 3,033,306 | 5/1962 | Hallene et al. | 181/233 |
| 3,688,870 | 9/1972 | Gibel | 181/267 |
| 3,983,956 | 10/1976 | Manhart | 181/210 |
| 4,167,986 | 9/1979 | Conway | 181/224 |
| 4,211,302 | 7/1980 | Matthews et al. | 181/252 X |
| 4,314,621 | 2/1982 | Hansen | 181/233 |
| 4,319,661 | 3/1982 | Proudfoot | 181/295 |
| 4,362,223 | 12/1982 | Meier | 181/224 X |
| 4,378,859 | 4/1983 | Satomi et al. | 181/224 |
| 4,548,292 | 10/1985 | Noxon | 181/295 |
| 4,572,327 | 2/1986 | Dean | 181/295 |

FOREIGN PATENT DOCUMENTS

| | | |
|---|---|---|
| 878854 | 9/1979 | Belgium . |
| 2226910 | 11/1974 | France . |
| 2348429 | 11/1977 | France . |

OTHER PUBLICATIONS

Rundfunktechnische Mitteilungen, Band 27, Nr. 2, Mar./Apr. 1983, Seiten 62–70, Norderstedt, DE H Wollherr, "Gestaltung des Abhorbereiches in einem Tonubertragunswagen".

Rundfunk Technische Mitteilungen, Band 29, Nr. 6, Dec./1985, Seiten 278–286, Norderstedt, DE T. J. Schultz, "Acoustical Uses for Perforated Metals".

*Primary Examiner*—B. R. Fuller

*Attorney, Agent, or Firm*—Sixbey, Friedman, Leedom & Ferguson

[57] ABSTRACT

A sound absorbing pipe comprising a circumferential wall, open portions disposed at regular intervals in the circumferential wall having a predetermined area ratio and sound absorbing material disposed in a hollow formed in an interior portion of the pipe.

16 Claims, 4 Drawing Sheets

SOUND ABSORBING PIPE

BACKGROUND OF THE INVENTION

1. Field of the Invention

The present invention relates to a sound absorbing material to be attached on a fence, a side wall, a ceiling, or the like which surrounds a noise source.

2. Prior Art

Conventionally, a number of structures have been employed as a fence, a side wal, or the like, surrounding a noise source. Japanese Patent Publication No. 51-46969/1976 (FIGS. 1(A)–1(G) discloses a structure in which cylindrical bodies of glass wool are fixed on the upper edge of a sound-insulation fence. Japanese 59-41400/1984 discloses a structure in which a sound absorbing board is stuck on the side of a sound-insulation fence (see FIGS. 2A, 2B).

In the sound absorbing structures as disclosed in the above-mentioned publications, it is possible to provide some degree of sound absorbing or soundproofing effects. However, problems arise in these structures in that positional limitations exist in the applications of the structures, directivity exists in the sound absorbing characteristics and the work necessary to attach the structures is troublesome and so on.

It is therefore an object of the present invention to provide a sound absorbing material which requires no directivity in sound absorbing characteristics, and hence, has no positional limitations in applications of the sound absorbing material.

It is a further object of the present invention to provide a sound absorbing material which is strong.

it is a further object of the present invention to provide a sound absorbing material which is easy to attach.

It is a further object of the present invention to provide a sound absorbing material which yields a high degree of sound absorbing performance.

SUMMARY OF THE INVENTION

To achieve the above-mentioned object, the sound absorbing member according to the present invention is arranged such that a sound absorbing material is disposed in the interior of a protection pipe in a hollow of the pipe having opening portions formed in a circumferential wall of the protection pipe at regular intervals with an open area ratio of not less than 25%.

BRIEF DESCRIPTION OF THE DRAWINGS

The invention will now be described in greater detail with reference to embodiments given solely to way of example and illustrated in the accompanying drawings in which.

DETAILED DESCRIPTION OF THE INVENTION

Figure 1:
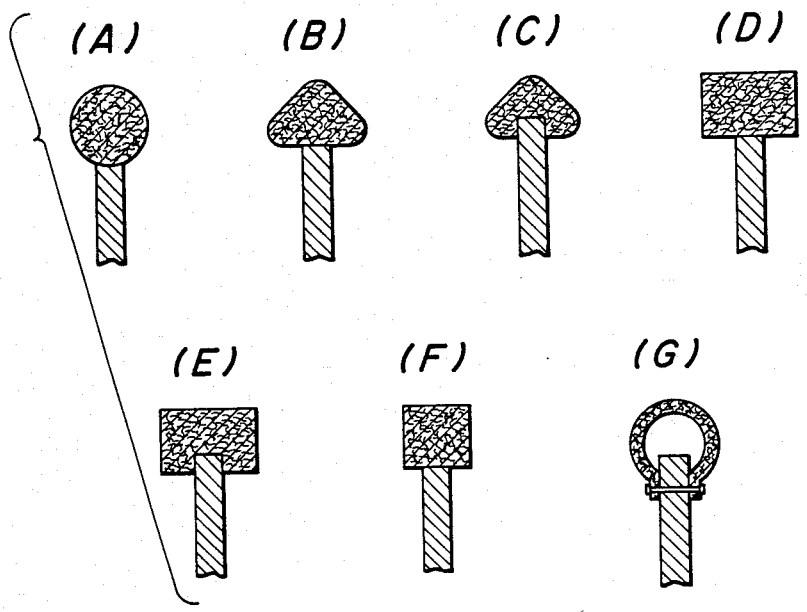
FIG. 1 PRIOR ART
FIGS. 1(A)–1(G), 2A and 2B show prior arrangements.
Figure 2A:
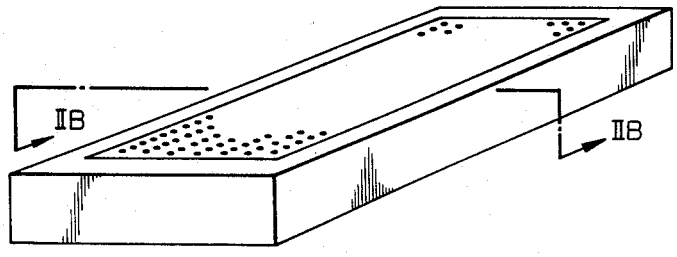
FIG. 2A PRIOR ART
Figure 2B:
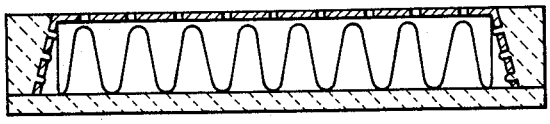
FIG. 2B PRIOR ART
Figure 3:
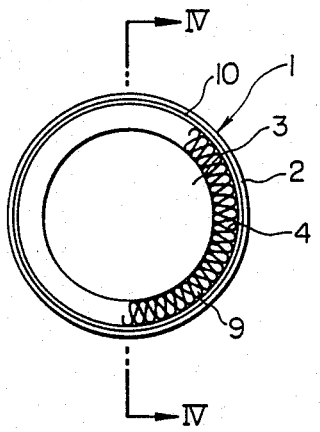
FIG. 3 is a front view showing a first embodiment of the present invention.

The sound absorbing pipe according to the present invention is arranged such that, as described above, the opening portions are formed in the circumferential wall of the protection pipe at regular intervals and the sound absorbing material is disposed interior of the protection pipe in the hollow of the pipe. The opening portions of the protection pipe are provided in the entire circumference, so that there is no directivity in sound absorbing characteristics thereof and good sound absorbing performance is exhibited wherever the sound absorbing pipe is used. Therefore, based on a comparison in which the same amount of sound material is used, the sound absorbing power according to the present invention is increased to about 1.5–2.4 times as strong as that disclosed in Japanese Utility Model Unexamined Publication No. 59-41400/1984, the amount of increase varying depending on the frequency of sound.

Being cylindrical, the sound absorbing pipe can be fixedly fastened by a band means or the like, thereby facilitating the attachment of the pipe onto the upper or lower ends of a fence, onto the upper inclined surfaces at the opposite sides of a road, onto the fences, the side walls, and the ceiling of an expressway onto the noise-insulation wall of a railway, and so on. In this manner, there is no limit to the applicability of the sound absorbing pipe. Since the sound absorbing material pipe is retained in the cylindrical protection pipe, the strong sound absorbing member is provided.

FIGS. 3 through 5A and 5B show a first embodiment in which a sound absorbing pipe 1 is constituted by a hollow protection pipe 2, a hollow sound absorbing material 4 having a lamination structure of rock wool or the like, provided in the interior of pipe 2 in space 3, and a film 10 coating the sound absorbing material 4.

The protection pipe 2 is made from a strong material having superior corrosion resistance, for example, stainless steel, aluminum, FRP, or the like. Pipe 2 is formed to be a hollow cylindrical body having a suitable sectional shape, and a number of opening portions 6 are equidistantly disposed in a circumferential wall 5 of the pipe 2. The open area ratio of the opening portions 6 in the circumferential wall 5 is selected to be not less than 25%. The upper limit of the open area ratio may be selected to be a desired value so long as the sound absorbing material 4 is not damaged or dropped off owing to contact with a foreign matter. However, the ratio is restricted to 80% for practical use.

Figure 5A:
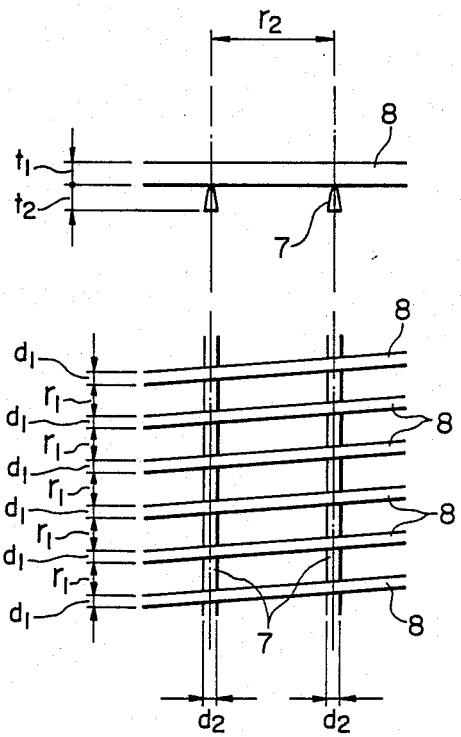
FIGS. 5A and 5B are enlarged perspective views showing portions of the protection pipe of FIG. 3 when viewed from the inside.
Figure 5B:
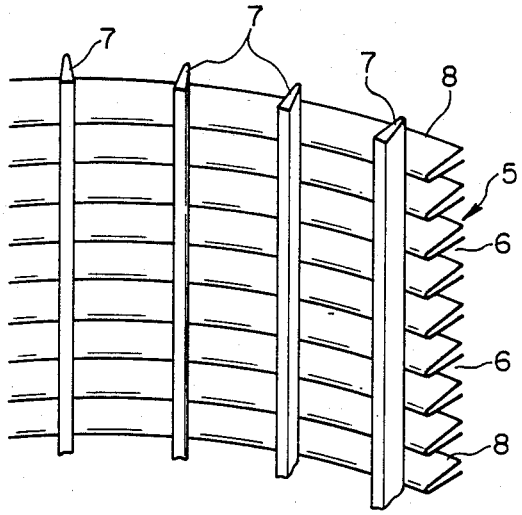

As shown in FIGS. 5A and 5B, the illustrated protection pipe 2 is arranged such that a stainless wire 8 having a triangular cross section is coiled on and welded to the outer circumference of a group of circumferentially equidistantly disposed stainless steel rods 7, which extend in the longitudinal direction of the pipe, to form a cylindrical netty body. The structure of the protection pipe 2 is, however, not limited to the illustrated structure.

In this embodiment, the dimensions of various members are selected to have values as shown in the following table.

| | | |
|---|---|---|
| Wire Width | $d_1$ | 1.54 mm |
| Wire Interval | $r_1$ | 5 mm |
| Rod Width | $d_2$ | 1.75 mm |
| Rod Center Interval | $r_2$ | 30 mm |

The open area ratio of the opening portions 6 is calculated to be 72% using the following formula.

$$\text{Open area ratio} = \frac{\text{Total area of opening portions}}{\text{Total surface area of protection tube}} \times 100 = 72\%$$

The sound absorbing material 4, formed of a hollow cylindrical body 9 of rock wool covered with a thin synthetic resin film 10 at its outer circumferential surface, is inserted into the hollow 3 of the protection pipe 2 so as internally touch the inner surface of the hollow 3. The hollow portion of the cylindrical body 9 is left intact.

Figure 4:
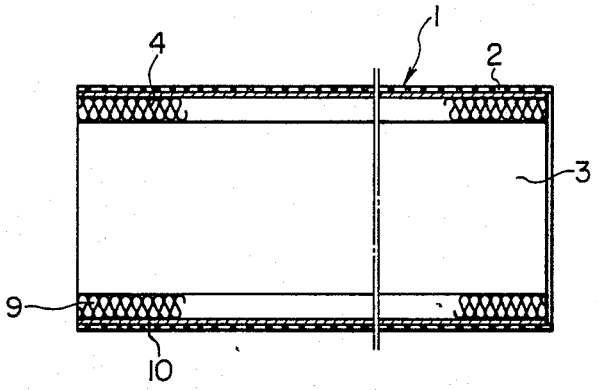
FIG. 4 is a cross-sectional view taken along a line IV—IV in FIG. 3.
Figure 6:
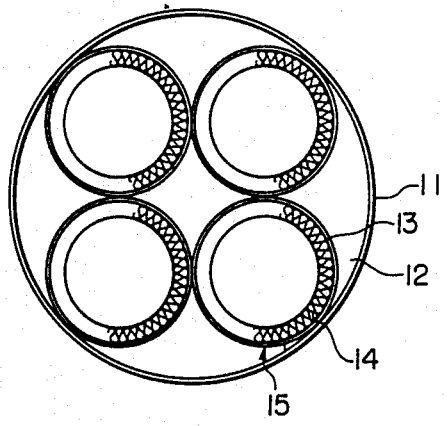
FIG. 6 is a front view showing a second embodiment according to the present invention.

FIG. 6 shows a second embodiment in which four hollow sound absorbing materials 15, each having a glass wool hollow cylindrical body 14 with its outer circumferential surface covered with a thin synthetic resin film 13 are disposed circumferentially side by side in a hollow 12 of a protection pipe 11 having the same structure as that shown in FIG. 4.

Five sound absorbing pipes were prepared according to the first embodiment as shown in FIGS. 3 through 5A and 5B. Each sound absorbing pipe is constituted by a sound absorbing material having a hollow cylindrical body having a 400 mm outer diameter, a 2000 mm length, and a 40 mm thickness and is made of rock wool of 80 Kg/m$^3$ in density. Five sound absorbing pipes prepared in such a manner as described above were disposed on a floor of a reverbation room side by side at intervals of 1 m, and sound absorbing power was measured by a reverberation method.

The sound absorbing power of the above-mentioned sound absorbing pipes was compared with that of a conventional rock wool flat plate having a 100 mm thickness and made of rock wool of 80 Kg/m$^3$ in density, the rock wool plate being spread over an area of 10 m$^2$ in the reverbation room. The following numerical results were obtained.

| | Frequency (Hz) | | | | | |
|---|---|---|---|---|---|---|
| | 125 | 250 | 500 | 1000 | 2000 | 40000 |
| First embodiment | 1.02 | 1.44 | 1.66 | 2.21 | 2.21 | 2.17 |

-continued

| | Frequency (Hz) | | | | | |
|---|---|---|---|---|---|---|
| | 125 | 250 | 500 | 1000 | 2000 | 40000 |
| Rock wool flat plate spread | 0.60 | 0.96 | 0.97 | 0.93 | 0.91 | 0.97 |

Unit of sound absorbing power: m$^2$ (meter sabin)

The results shown in the above table confirm that the sound absorbing power of the sound absorbing pipe according to the present invention is 1.5–2.4 times as strong as that of the sound absorbing material of the plane plate. Thus, if the two were made equal to each other in sound absorbing effect, the area of execution of sound absorption by means of the sound absorbing member of the present invention is decreased to about one half that of the conventional one. Although not limited to a cylindrical shape, it is preferable to provide a cylindrical shape in view of the improvement in sound absorbing characteristics in the low frequency ranges.

It is preferable to select the open area ratio in the circumferential wall of the protection pipe to be not less than 25% but within a range in which the protecting function is not lost, because the sound absorbing effect becomes extremely low if the open area ratio is less than 25%.

Though the sound absorbing material is not specifically limited in its quality, it is preferable to use rock wool or glass wool because they are light in weight and they have superior sound absorbing properties as well as superior corrosion resistance.

As the film for covering the outer circumferential surface of the sound absorbing material, it is a matter of course to select a synthetic resin film which is thin and so thin as to ameliorate the sound absorbing effect. The film should be superior in water-proof qualities as well as in moisture-proof qualities.

The protection pipe may be formed of a plate having holes bored therein, a netty body, or the like.

Figure 7:
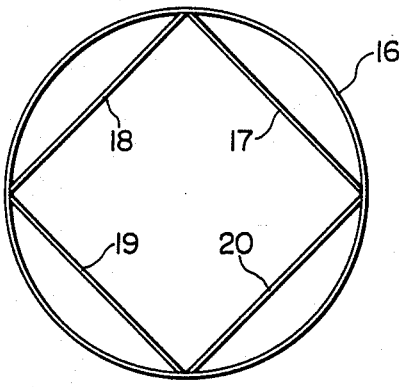
FIG. 7 is a front view showing a third embodiment according to the present invention.

FIG. 7 is a front view showing a third embodiment, in which sintered aluminum sound absorbing plates 17, 18, 19 and 20 are arranged to form a square-pipe in the inside of a protection pipe 16, the 16 being the same as that of the first and the second embodiments.

Figure 8:
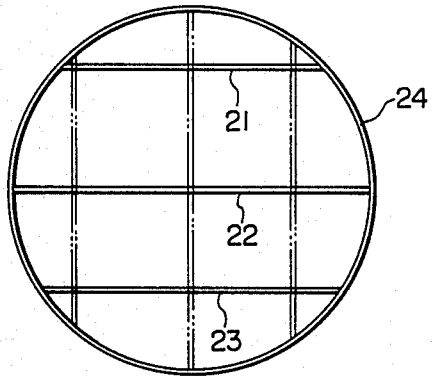
FIG. 8 is a front view showing a fourth embodiment according to the present invention.

FIG. 8 shows a fourth embodiment, in which sintered aluminum sound absorbing plates 21, 22 and 23, which are the same as those shown in FIG. 7, are disposed in parallel to each other in the inside of a protection pipe 24.

The above-mentioned sintered aluminum sound absorbing plates may be replaced by, for example, concrete foam plates or other known sound absorbing plates.

Figure 9:
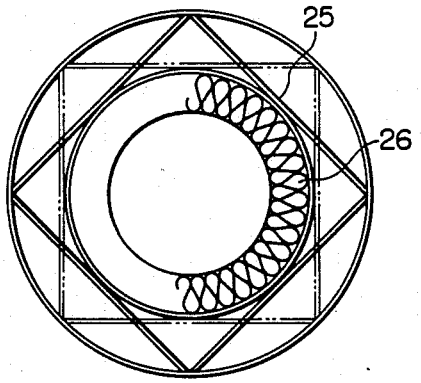
FIG. 9 is a front view showing a fifth embodiment according to the present invention.

FIG. 9 shows a fifth embodiment, in which a cylindrical sound absorbing material 26, similar to that shown in the first embodiment, is disposed inside a square-pipe 25 constituted by sintered aluminum sound absorbing plates of the sound absorbing pipe shown in FIG. 7.

Figure 10:
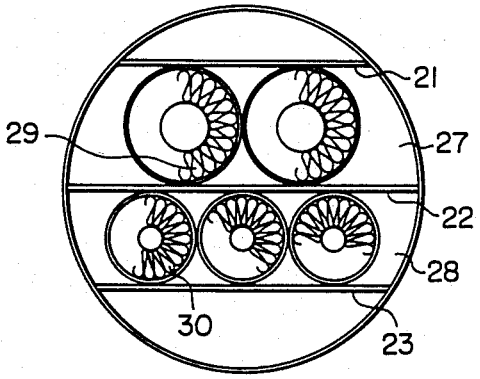
FIG. 10 is a front view showing a sixth embodiment according to the present invention.

FIG. 10 shows a sixth embodiment, in which a plurality of small diameter cylindrical sound absorbing materials 29 and 30 similar to those used in the second embodiment shown in FIG. 6 are disposed in the interior of the sound absorbing pipe of FIG. 8 in hollows 27 and 28 constituted by sintered aluminum sound absorbing plates 21, 22 and 23.

In the case of using the sound absorbing pipes having structures shown in FIGS. 7 through 10, respectively, in any case where the sound absorbing pipes are connected longitudinally with each other or disposed radially side by side, it is preferable, to achieve improved sound absorbing effects, to arrange the sound absorbing plates of sintered aluminum or the like in the adjacent sound absorbing pipes in the execution of work, so as to intersect each other as shown by the chain lines in FIGS. 8 and 9.

Figure 11:
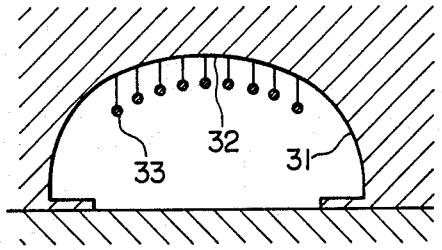
FIG. 11 is a schematic cross-sectional view illustrating the execution of work in a tunnel.

FIGS. 11 through 16 show different examples of execution of work according to the present invention. FIG. 11 shows an example in which a plurality of sound absorbing pipes 33 according to the present invention are disposed on a ceiling surface 32 of a tunnel 31 in parallel to each other in the longitudinal direction of the tunnel 31.

Figure 12:
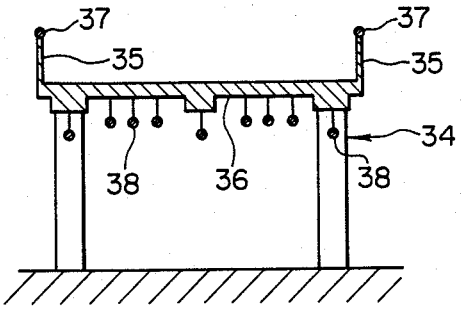
FIG. 12 is a schematic cross-sectional view illustrating the execution of work on an expressway.

FIG. 12 shows an example in which a plurality of sound absorbing pipes 37 and 38 according to the present invention are disposed in parallel to each other on the upper edge of a fence 35 and on the lower surface of a ceiling 36 of an expressway 34 having two paths, an upper path and a lower path.

Figure 13:
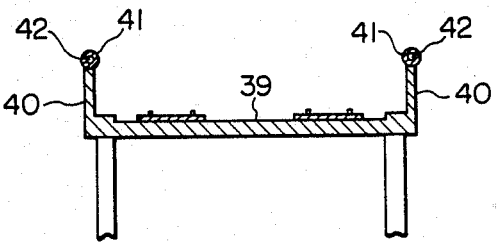
FIG. 13 is a schematic cross-sectional view illustrating the execution of work on a high-speed railroad floor.

FIG. 13 shows an example in which a series of sound absorbing pipes 41 according to the present invention are disposed on the upper edge a fence 40 on each of the opposite sides of a high-speed railroad floor 39. Various kinds of communication cables may be disposed in a hollow hole 42 of the sound absorbing material constituting each of the sound absorbing pipes 41 so as to also use the sound insulation structure as a cable laying structure.

Figure 14:
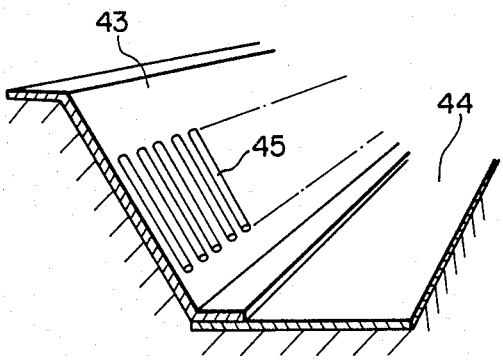
FIG. 14 is a schematic perspective view illustrating the execution of work on inclined surfaces.

FIG. 14 shows an example in an expressway 44 having inclined surfaces 43 at its opposite sides, in which a number of sound absorbing pipes 45 according to the present invention are disposed side by side on the inclined surfaces 43.

Figure 15:
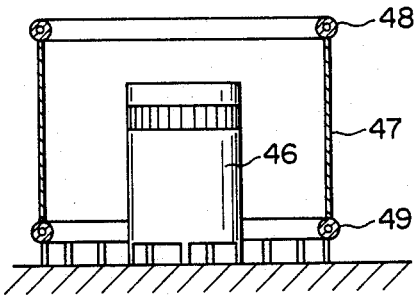
FIG. 15 is a schematic cross-sectional view illustrating the execution of work on a fence surrounding a noise source.

FIG. 15 shows an example in which sound absorbing pipes 48 and 49 according to the present invention are disposed on the upper edge and the lower edge of a sound-insulating fence 47 surround a cooling tower 46 disposed on the roof of a building or the like so as to improve the noise insulation effect.

Figure 16:
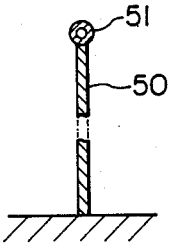
FIG. 16 is a schematic cross-sectional view illustrating the execution of work on a fence, or the like, of a factory.

FIG. 16 shows an example in which sound absorbing pipes 51 according to the present invention are disposed on the upper edge of a fence 50 surrounding a press factory or the like so as to improve the noise insulation effect.

Having such an arrangement and operations as described above, the present invention achieves meritorious effects with respect to following points. Being arranged such that the sound absorbing material is accommodated in the protection pipe having the opening portions formed at regular intervals with an open area ratio of not less than 25%, the sound absorbing pipe will have no directivity in sound absorbing characteristics and will have a single structure. Thus, the pipe can be used with no limitations in the positional application thereof.

Further, being arranged such that the sound absorbing material is disposed inside the protection pipe, the sound absorbing pipe is strong enough in structure for long use outdoors. Having a cylindrical shape, the sound absorbing pipe can be fixed through fastening by an attachment means such as a band on the like, which is relatively easy to execute, thereby facilitating the execution work.

Although the invention has been described with reference to particular means, methods, and embodiments, it is to be understood that the invention is not confined to the embodiments described in the foregoing and illustrated herein, but extends to all equivalents within the scope of the claims.

What is claimed is:

1. A sound absorbing pipe comprising:

a cylindrical shaped substantially hollow body comprising one or more elements having an interior surface and two ends;

open portions provided at generally regular intervals between said one or more elements and forming with said one or more elements a circumferential wall, wherein a predetermined open area ratio exists between an area formed of said open portions with respect to an overall area of said circumferential wall;

a plurality of rods disposed within an interior of said circumferential wall equidistantly so as to extend longitudinally of said body;

a wire being coiled around an outer circumference of said plurality of rods and being welded thereto; and sound absorbing material disposed in a layer of generally uniform thickness adjacent to said circumferential wall, said interior surface of said circumferential wall being substantially entirely covered with said layer, an interior surface of said layer bounding a hollow area formed in an interior portion of said body, said hollow area being in communication with both of said two ends;

wherein sound generated outside of said sound absorbing pipe passes through said open portions and is absorbed within said sound absorbing pipe.

2. The sound absorbing pipe according to claim 1 wherein said predetermined open area ratio is approximately 72%.

3. The sound absorbing pipe according to claim 1 wherein said predetermined open area ratio is not less than 25%.

4. The sound absorbing pipe according to claim 1 wherein said plurality of rods and said wire comprise stainless steel and said wire has a triangular cross-section.

5. The sound absorbing pipe according to claim 1 wherein said sound absorbing material comprises:

a hollow cylindrical member; and a thin synthetic resin film surrounding said hollow cylindrical member.

6. The sound absorbing pipe according to claim 5 wherein said hollow cylindrical member comprises a material selected from the group of rock wool and glass wool.

7. The sound absorbing pipe according to claim 1 wherein said sound absorbing material is disposed in said hollow area formed in the interior portion of said body so as to internally touch said interior surface.

8. A sound absorbing pipe according to claim 1, wherein said circumferential wall and said layer of sound absorbing material are substantially coaxially disposed about said hollow interior.

9. A sound absorbing pipe comprising:

a body comprising one or more elements forming an exterior circumferential wall having an interior surface and two ends;

open portions provided at generally regular intervals between said one or more elements and forming with said one or more elements said exterior circumferential wall wherein a predetermined open area ratio exists between an area formed of said open portions with respect to an overall area of said exterior circumferential wall;

said body having a hollow interior which communicates with both of said two ends; and sound absorbing material being disposed in said interior of said body, said sound absorbing material including a plurality of sound absorbing plates arranged to form a cross-sectionally square-shaped structure extending longitudinally in said hollow interior of said body;

wherein sound generated outside said sound absorbing pipe passes through said open portions and is absorbed by said sound absorbing material.

10. The sound absorbing pipe according to claim 9 wherein said plates are formed from a material selected from the group of sintered aluminum and concrete foam.

11. The sound absorbing pipe according to claim 9 wherein said sound absorbing material further comprises a sound absorbing hollow cylindrical member disposed in another interior formed by said plurality of sound absorbing plates.

12. The sound absorbing pipe according to claim 9 wherein said sound absorbing material comprises a plurality of sound absorbing plates disposed longitudinally and parallel to one another inside of said body.

13. The sound absorbing pipe according to claim 12 wherein said plates are formed from a material selected from the group of sintered aluminum and concrete foam.

14. A sound absorbing pipe comprising:

a body comprising one or more elements forming an exterior circumferential wall having an interior surface and two ends;

open portions provided at generally regular intervals between said one or more elements and forming with said one or more elements said exterior circumferential wall wherein a predetermined open area ratio exists between an area formed of said open portions with respect to an overall area of said exterior circumferential wall;

said body having a hollow interior which communicates with both of said two ends; and sound absorbing material being disposed in said hollow interior of said body, said sound absorbing material including a plurality of sound absorbing plates disposed longitudinally within said body and between said plurality of hollow cylindrical members, with an outer surface of each of said members being surrounded by thin synthetic resin film, said film being substantially water-proof and moisture-proof, with said members being disposed circumferentially side-by-side in said hollow interior of said body;

wherein sound generated outside said sound absorbing pipe passes through said open portions and is absorbed by said sound absorbing material.

15. The sound absorbing pipe according to claim 14 wherein said plates are formed from a material selected from the group of sintered aluminum and concrete foam.

16. A sound absorbing pipe comprising:

a body comprising one or more elements forming an exterior circumferential wall having an interior surface and two ends;

open portions provided at generally regular intervals between said one or more elements and forming with said one or more elements said exterior circumferential wall;

said body having a hollow interior which communicates with both of said two ends; and sound absorbing material disposed within said hollow interior of said body;

wherein sound generated outside said sound absorbing pipe passes through said open portions and is absorbed by said sound absorbing material.

* * * * *